US006308029B1

(12) United States Patent
Yamamoto

(10) Patent No.: US 6,308,029 B1
(45) Date of Patent: Oct. 23, 2001

(54) ELECTROPHOTOGRAPHIC IMAGE FORMING DEVICE HAVING AN EXCHANGEABLE BELT AND A METHOD OF EXCHANGING THE SAME

(75) Inventor: Kazuoki Yamamoto, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/547,298

(22) Filed: Apr. 11, 2000

(30) Foreign Application Priority Data

Apr. 13, 1999 (JP) ..... 11-105957

(51) Int. Cl.[7] ..... G03G 15/00
(52) U.S. Cl. ..... 399/117; 399/124; 399/125
(58) Field of Search ..... 399/107, 110, 399/116, 117, 124, 125, 159, 162, 165, 167, 302, 308, 313

(56) References Cited

U.S. PATENT DOCUMENTS 5,400,121 * 3/1995 Foote ..... 399/116
5,974,289 * 10/1999 Yamaguchi ..... 399/124

FOREIGN PATENT DOCUMENTS 57-122468 7/1982 (JP) .
60-194468 10/1985 (JP) .
63-195356 12/1988 (JP) .
4-204558 7/1992 (JP) .
5-502119 4/1993 (JP) .
5-165298 7/1993 (JP) .
6-110261 4/1994 (JP) .
6-186896 7/1994 (JP) .
9-236993 9/1997 (JP) .

OTHER PUBLICATIONS

Japanese Office Action issued May 23, 2000 in a related application with English translation of relevant portions.

* cited by examiner

*Primary Examiner*—Sophia S. Chen
*Assistant Examiner*—Hoang Ngo
(74) *Attorney, Agent, or Firm*—Ostrolenk, Faber, Gerb & Soffen, LLP

(57) ABSTRACT

An electrophotographic image forming device has a body including an upper housing and a lower housing, a photosensitive belt which is provided in the body, a belt driver for rotating the photosensitive belt, which is covered with the photosensitive belt, and a hinge joining the upper housing, the lower housing, and the belt driver so as to enable the upper housing and the belt driver to swing with respect to the lower housing.

19 Claims, 8 Drawing Sheets

ELECTROPHOTOGRAPHIC IMAGE FORMING DEVICE HAVING AN EXCHANGEABLE BELT AND A METHOD OF EXCHANGING THE SAME

BACKGROUND OF THE INVENTION

1. Field of the Invention

The present invention relates to an electrophotographic image forming device, such as an electrophotographic printer, and an exchange method of a photosensitive belt and a transfer belt comprising the same. In particular, the present invention relates to an electrophotographic image forming device having a simple structure and an exchange method of a photosensitive belt and a transfer belt, which can be easily carried out.

This application is based on Japanese Patent Application No. Hei 11-105957, the contents of which are incorporated herein by reference.

2. Description of the Related Art

A conventional electrophotographic image forming device, such as an electrophotographic printer, comprises a photosensitive belt. The photosensitive belt is consumable; therefore, the photosensitive belt must be exchanged, depending on its use period or the printing frequency. FIG. 6 shows an internal constitution of a conventional electrophotographic printer viewed from the front side.

In the conventional electrophotographic printer, a tray 29*a* for storing recording media, such as printing paper, and some pairs 32 of transferring rollers for transferring the recording medium are provided in the body 21. The pair 32 of transferring rollers is provided with the body 21 so that each of the rollers rotates.

In addition, a photosensitive belt 22 and a belt driver 31 for the photosensitive belt 22 are provided in the body 21. The belt driver 31 comprises four driving rollers 23, 24, 25, and 26. The three rollers 23, 24, and 25 among the driving rollers 23, 24, 25, and 26 are located so as to form a triangle. Another driving roller 26 is located between the driving rollers 24 and 25. The longitudinal directions of these driving rollers 23, 24, 25, and 26 are parallel. The photosensitive belt 22 is located so as to contact with the surface of the driving rollers 23, 24, 25, and 26 while being taut. Moreover, the driving roller 25 can shift toward the driving roller 24. When the driving roller 25 shifts toward the driving roller 24, the tension of the photosensitive belt 22 loosens.

A developing roller 27 is located opposite to the driving roller 26 with respect to the photosensitive belt 22 so that the developing roller 27 and driving roller 26 sandwich the photosensitive belt 22. The developing roller 27 is provided with the body 21 so as to be able to shift downwardly. Furthermore, a transfer roller 28 is located opposite to the driving roller 23 with respect to the photosensitive belt 22 so that the transfer roller 28 and the driving roller 28 sandwich the photosensitive belt 22 and the recording medium 29 which is transferred from the tray 29*a*. The transfer roller 28 is provided with the body 21 so as to be able to shift upwardly. The developing roller 27 makes an image to be printed at the recording medium 29 onto the photosensitive belt 22 by toners thereto adhering. Then, the transfer roller 28 transfers the image comprising toners which is formed onto the photosensitive belt 22 to the recording medium 29.

The photosensitive belt 22 provided with the conventional electrophotographic printer is changed by the following processes. FIGS. 7A to 7D, 8A, and 8B show the exchange processes of the photosensitive belt 22.

As shown in FIG. 7A, the developing roller 27 shifts downwardly, as indicated by the arrow F. Then, the transfer roller 28 shifts upwardly, as indicated by the arrow G. Thereby, the photosensitive belt 22 does not contact with the developing roller 27 and the transfer roller 28, as shown in FIG. 7B.

After that, the driving roller 25 shifts toward the driving roller 24, as indicated by the arrow H in FIG. 7C. Thereby, the tension of the photosensitive belt 22 lossens. Then, the photosensitive belt 22 is removed from the printer through the opening formed at the front of the printer by peeling the photosensitive belt 22 from the belt driver 31, as indicated by the arrow I in FIG. 7D.

In order to fit a new photosensitive belt 22 into the printer, the new photosensitive belt 22 is fitted with the printer by being passes through the opening formed at the front of the printer, and covering the belt driver 31. The driving roller 25 returns to the place where it was by shifting as indicated by the arrow K in FIG. 8B. Thereby, the photosensitive belt 22 becomes tense. Then, the developing roller 27 shifts upwardly as indicated by the arrow L, and sandwiches the photosensitive belt 22 together with the driving roller 26 opposite to the developing roller 27. The transfer roller 28 shifts downwardly as indicated by the arrow M, and sandwiches the photosensitive belt 22 together with the driving roller 23 opposite to the developing roller 28. The photosensitive belt 22 is exchanged by these processes.

However, in order to exchange the photosensitive belt 22 in the conventional electrophotographic printer, it is necessary to shift the developing roller 27, the transfer roller 28, etc., and members for shifting the developing roller 27, the transfer roller 28, etc. are needed. Therefore, the problem arises that the structure of the printer is complicated. In addition, the exchange method of the photosensitive belt 22 is also complicated.

It is therefore an object of the present invention to provide an electrophotographic image forming device which has a simple structure and in which a photosensitive belt or a transfer belt is easily exchanged, and an exchange method of a photosensitive belt and a transfer belt, which can be easily carried out.

SUMMARY OF THE INVENTION

According to a first aspect of the present invention, the present invention provides an electrophotographic image forming device comprising:

- a body comprising an upper housing and a lower housing,
- a photosensitive belt which is provided in the body,
- a belt driver for rotating the photosensitive belt, which is covered with the photosensitive belt, and
- a hinge joining the upper housing, the lower housing, and the belt driver, and make the upper housing and the belt driver swing with respect to the lower housing.

According to the electrophotographic image forming device, the upper housing, the lower housing and the belt driver are joined via the hinge. When the upper housing swings with respect to the belt driver, and the belt driver swings with respect to the lower housing, the belt driver separates from the upper and lower housing. Therefore, the photosensitive belt covering the belt driver can be easily exchanged.

In particular, it is preferable that the belt driver comprises a plurality of driver rollers of which the rotation axes are parallel and a tension loosen equipment for loosing the tension of the photosensitive belt comprising at least one shiftable driver roller. According to the electrophotographic image forming device, the photosensitive belt can be easily removed from the belt driver by loosening the tension of the photosensitive belt using the tension loosen equipment.

In addition, it is preferable to provide a developing roller in the lower housing, and a transfer roller in the upper housing. When the developing roller is provided in the lower housing, and the transfer roller is provided in the upper housing, the developing roller and the transfer roller easily separates from the photosensitive belt covering the belt driver only by swinging the upper housing swings with respect to the belt driver, and the belt driver swings with respect to the lower housing. That is, according to the electrophotographic image forming device, the special equipments for displacing the developing roller and the transfer roller are not needed in order to only exchange the photosensitive belt. Therefore, the electrophotographic image forming device has a simple structure and a low manufacturing cost, compared with a conventional electrophotographic image forming device.

According to a second aspect of the present invention, the present invention provides an exchange method of a photosensitive belt provided in an electrophotographic image forming device according to a first aspect of the present invention, comprising the steps of:

swinging the upper housing due to the hinge with respect to the fixed lower housing, swinging the belt driver due to the hinge so that the belt driver positions between the upper housing and lower housing in a swinging direction, pulling the photosensitive belt from the belt driver, returning a new photosensitive belt onto the belt driver, and closing the upper housing and belt driver using hinge According to the exchange method of a photosensitive belt, when the upper housing swings with respect to the belt driver, and the belt driver swings with respect to the lower housing, the belt driver separates from the upper and lower housing. Therefore, the photosensitive belt covering the belt driver can be easily exchanged.

DESCRIPTION OF THE PREFERRED EMBODIMENTS

Figure 1:
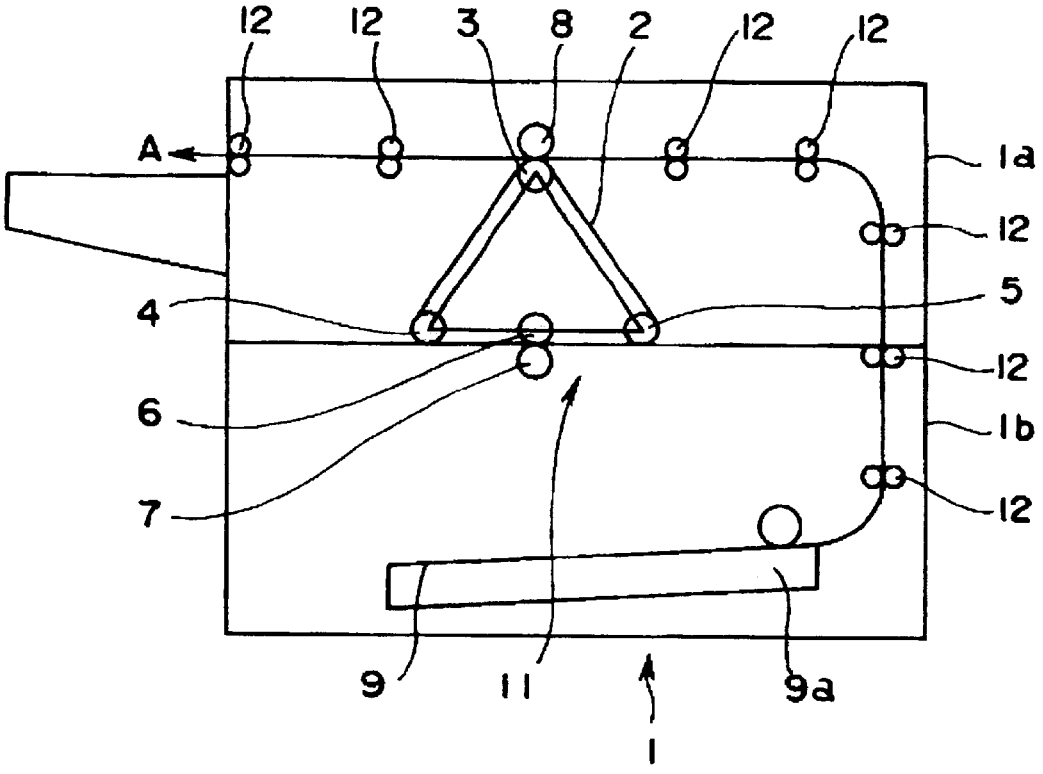
FIG. 1 is a schematic view showing an internal constitution of an electrophotographic printer according to the present invention viewed from the front side.

An embodiment of the electrophotographic image forming device and the exchange method of the photosensitive belt and the transfer belt according to the present invention will be explained referring to Figures. Moreover, only an exchange method of the photosensitive belt will be explained in the following embodiment. However, the exchange method is absolutely applied to the transfer belt.

As shown in FIGS. 1, 2, 3, and 5, a body 1 comprises an upper housing 1*a* and a lower housing 1*b*. A tray 9*a* for storing recording media 9, such as printing paper and some pairs 12 of transferring rollers for transferring the recording medium 9 are provided in the body 1. The pair 12 of transferring rollers is provided with the upper and lower housings 1*a* and 1*b*.

In addition, a photosensitive belt 2 and a belt driver 11 for the photosensitive belt 2 are provided in the body 1. The belt driver 11 comprises four driving rollers 3, 4, 5, and 6. The three rollers 3, 4, and 5 among the driving rollers 3, 4, 5, and 6 are located so as to form a triangle. Another driving roller 6 is located between the driving rollers 4 and 5. The longitudinal directions of these driving rollers 3, 4, 5, and 6 are parallel. The photosensitive belt 2 is located so as to contact with the surface of the driving rollers 3, 4, 5, and 6 while being taut. Moreover, the driving roller 5 can shift toward the driving roller 4 using shifting equipment (not shown in Figs). When the driving roller 5 shifts toward the driving roller 4, the tension of the photosensitive belt 2 loosens.

A developing roller 7 is located opposite to the driving roller 6 with respect to the photosensitive belt 2 so that the developing roller 7 and driving roller 6 sandwich the photosensitive belt 2. The developing roller 7 is provided with the lower housing 1*b* so as to rotate on its center axis. Furthermore, a transfer roller 8 is located opposite to the driving roller 3 with respect to the photosensitive belt 2 so that the transfer roller 8 and the driving roller 3 sandwich the photosensitive belt 2 and the recording medium 9 which is transferred from the tray 9*a*. The transfer roller 8 is provided with the upper housing 1*a* so as to rotate on its center axis.

Figure 3:
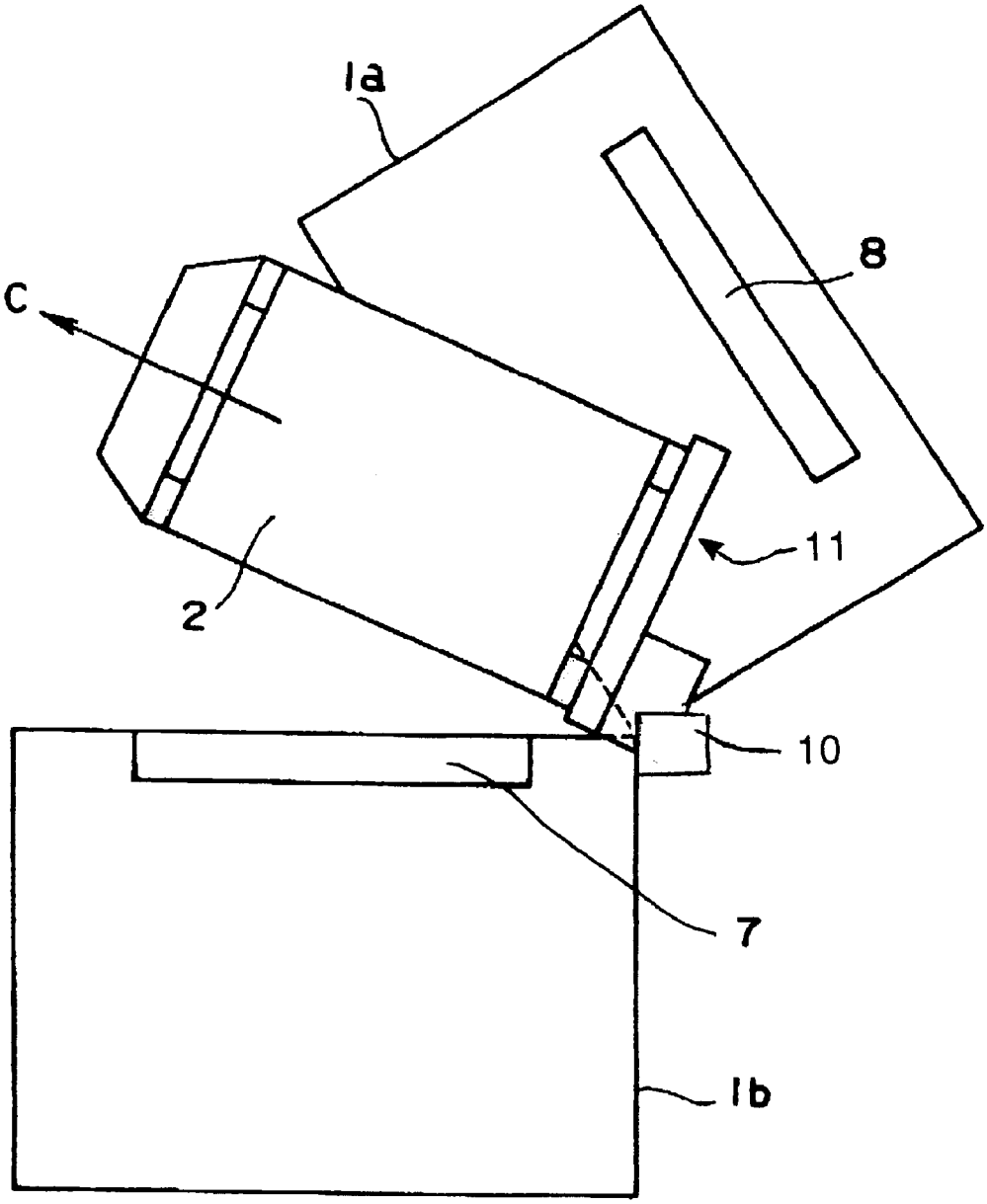
FIG. 3 is a schematic view for explaining a removing method of a photosensitive belt.
Figure 4:
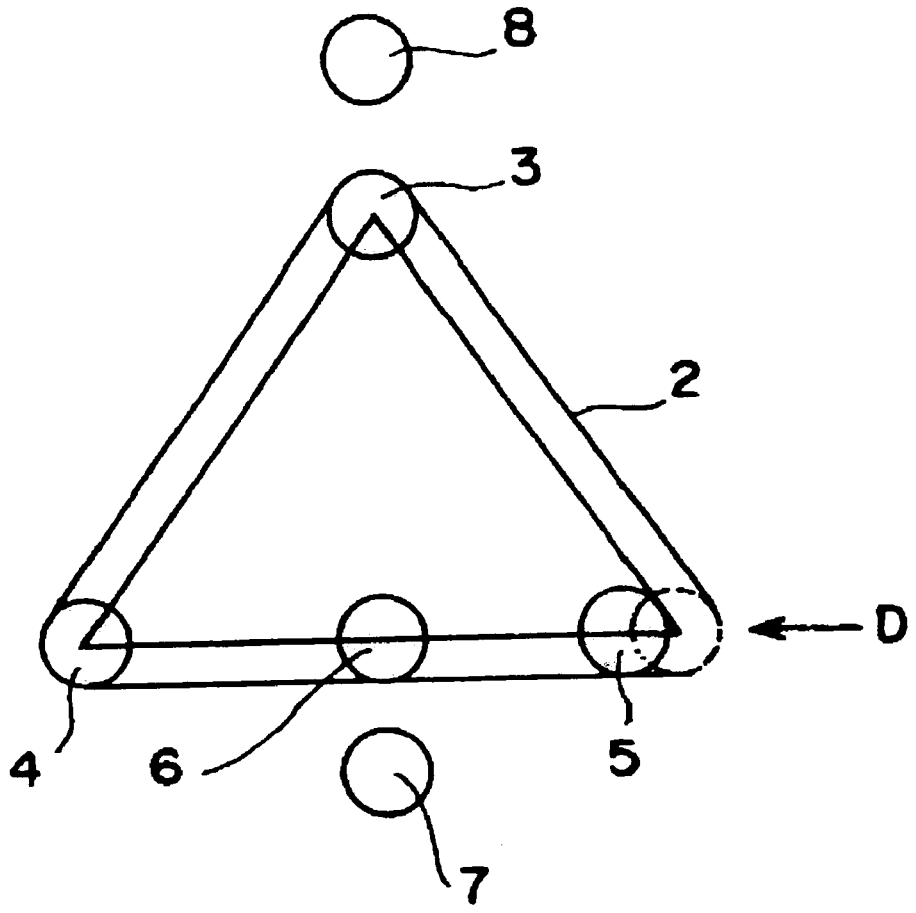
FIG. 4 is a schematic view for explaining movements of driving rollers when the photosensitive belt is removed.

The upper housing 1*a* and the lower housing 1*b* are jointed via a hinge 10. In addition, the belt driver 11 is also jointed to the hinge 10. Furthermore, a first positioning section (not shown in Figs) and a second positioning section are provided. When the upper housing 1*a* swings, separates from the lower housing 1*b*, and opens, the first positioning section maintains a fixed swinging angle for the upper housing 1*a*, as shown in FIG. 3. When the belt driver 11 swings, the second positioning section maintains a fixed swinging angle for the belt driver 11, which is smaller than the swinging angle for the upper housing 1*a*. That is, the maximum swinging angle for the belt driver 11 is smaller than that of the upper housing 1*a*. Thereby, the belt driver 11 is positioned between the upper and lower housings 1*a* and 1*b* in the swing direction of the upper housing 1*a* and the belt driver 11. That is, when the upper housing 1*a* and the belt driver 11 swing before their maximum swinging angle, the transfer roller 8 and the developing roller 7 separate from the photosensitive belt 2, as shown in FIG. 3.

Below, the printing processes in this electrophotographic image forming device will be explained. As shown in FIG. 1, the recording medium 9 stored in the tray 9*a* is fed along the route indicated by the A-arrow by some pairs 12 of transferring rollers. While the recording medium 9 reaches at the interval between the transfer roller 8 and the driving roller 3, the developing roller 7 makes an image to be printed at the recording medium 9 onto the photosensitive belt 2 by adhering toners thereto. When the recording medium 9 passes through the interval between the driving roller 3 and the transfer roller 8, the image made by toners is transferred from the photosensitive belt 2 to the recording medium 9. After that, the recording medium printed with the image is sent out from the electrophotographic image forming device through an outlet.

Below, an exchange method of the photosensitive belt 2 will be explained referring to FIGS. 2 to 5.

Figure 2:
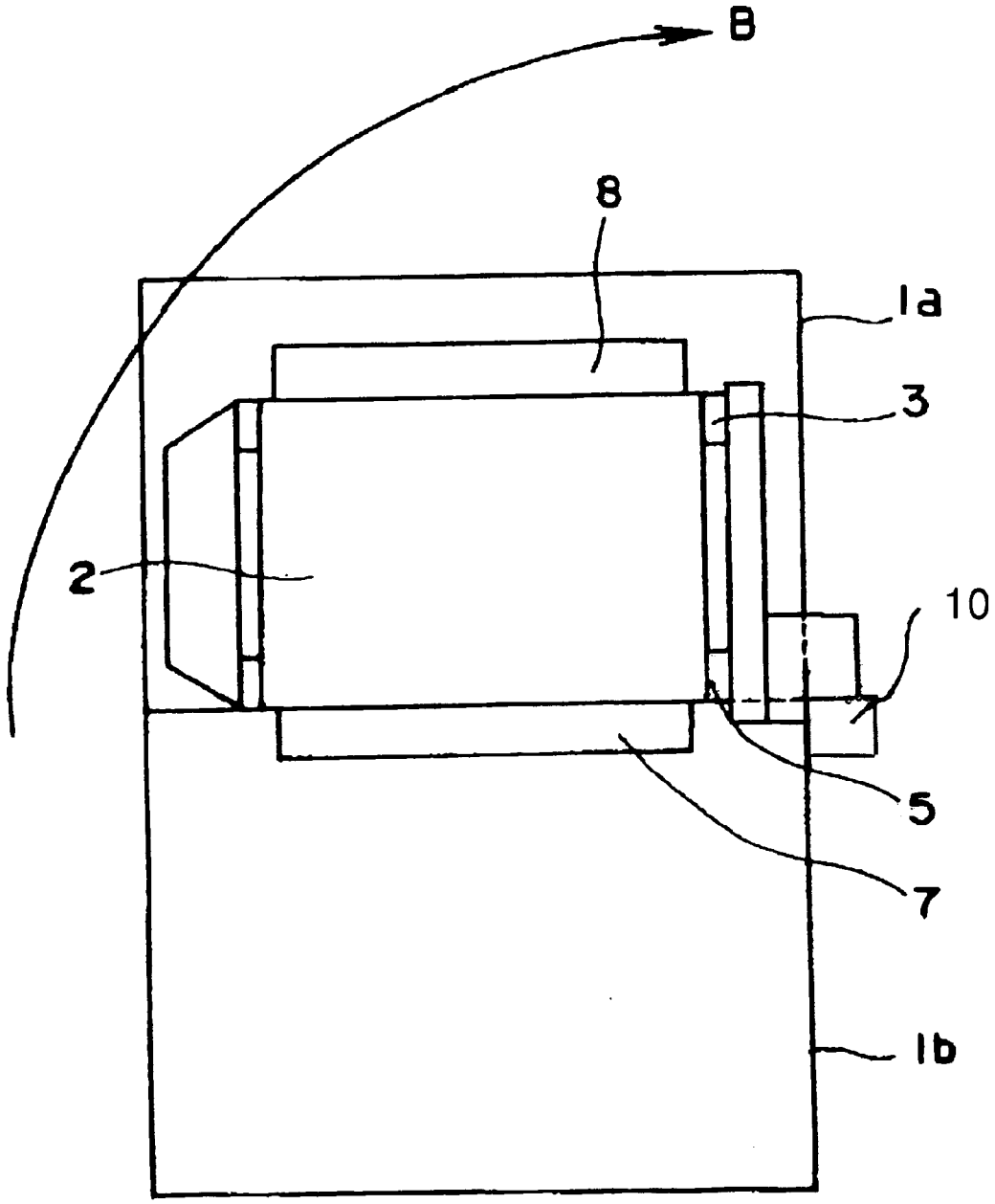
FIG. 2 is a schematic view showing the internal constitution of the electrophotographic printer shown in FIG. 1 viewed from the right side.

The upper housing 1*a* swings with respect to the fixed lower housing 1*b* in the swing direction indicated by the B-arrow in FIG. 2 using the hinge 10. Then, the belt driver 11 also swings accompanied by the swing of the upper housing 1*a*. As explained above, the maximum swinging angle for the belt driver 11 is smaller than that of the upper housing 1*a* due to the first and second positioning sections. Therefore, the swing of the belt driver 11 is stopped, and then the swing of the upper housing 1*a* is also stopped. Thereby, the photosensitive belt 2 covering the belt driver 2 separates from the lower and upper housings 1*a* and 1*b*. That is, the photosensitive belt 2 separates from the developing roller 7 and the transfer roller 8, as shown in FIG. 3. After that, the driving roller 5 is shifted toward the driving roller 4, that is, in the direction indicated by the D-arrow in FIG. 4. Thereby, the tension of the photosensitive belt 2 loosens. The photosensitive belt 2 can be removed from the belt driver 11 by pulling the photosensitive belt 2 in the direction indicated by the C-arrow in FIG. 3.

Figure 5:
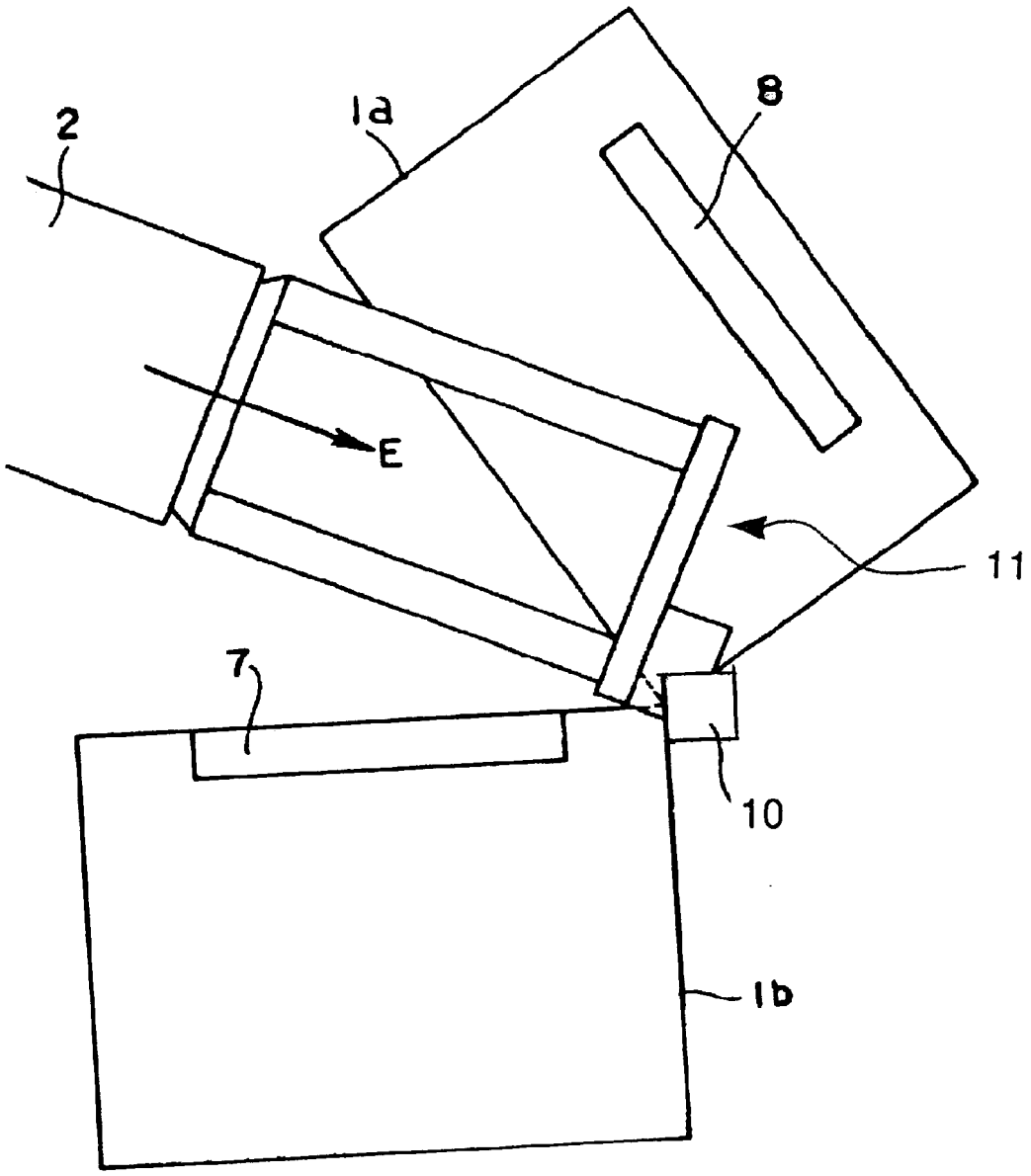
FIG. 5 is a schematic view for explaining a fitting method of the photosensitive belt.
Figure 6:
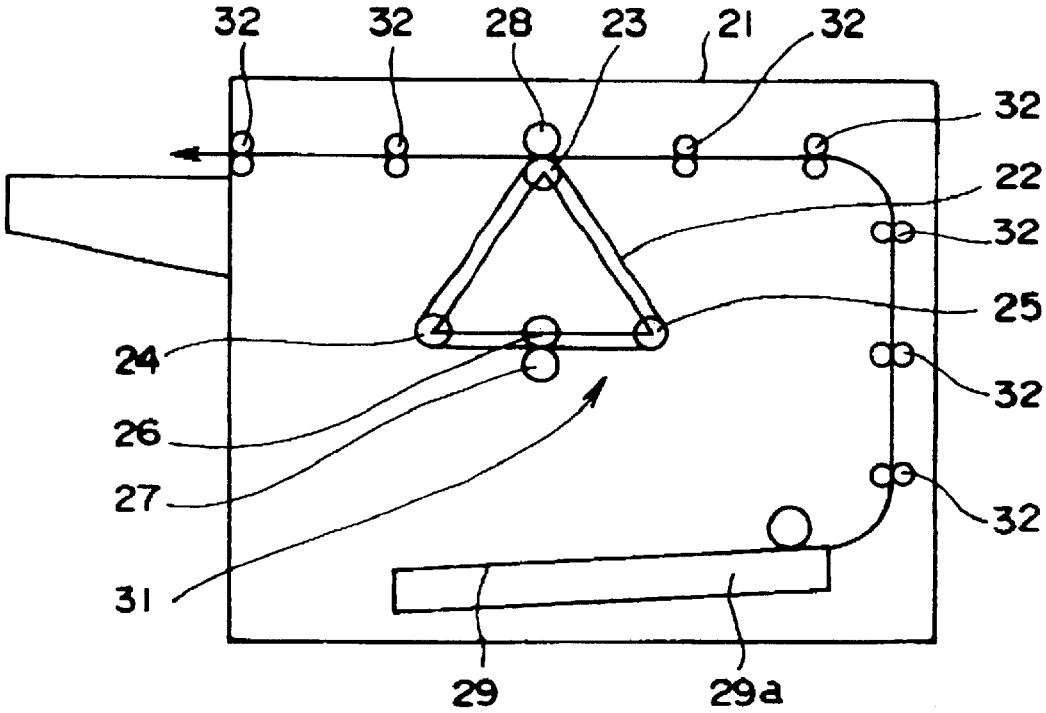
FIG. 6 is a schematic view showing an internal constitution of a conventional electrophotographic printer viewed from the front side.
Figure 7A:
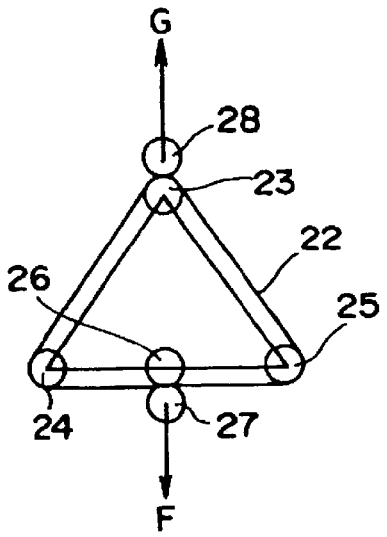
FIGS. 7A to 7D are schematic views for explaining a removing method of a photosensitive belt provided in a conventional electrophotographic printer.
Figure 7B:
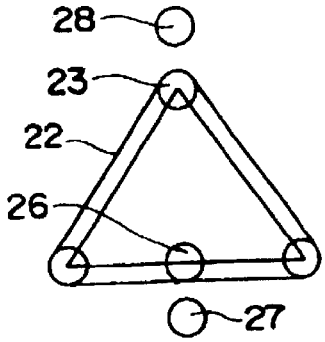
Figure 7C:
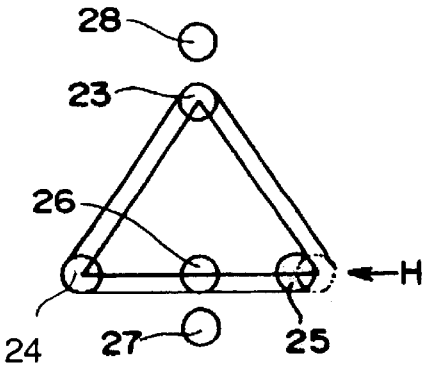
Figure 7D:
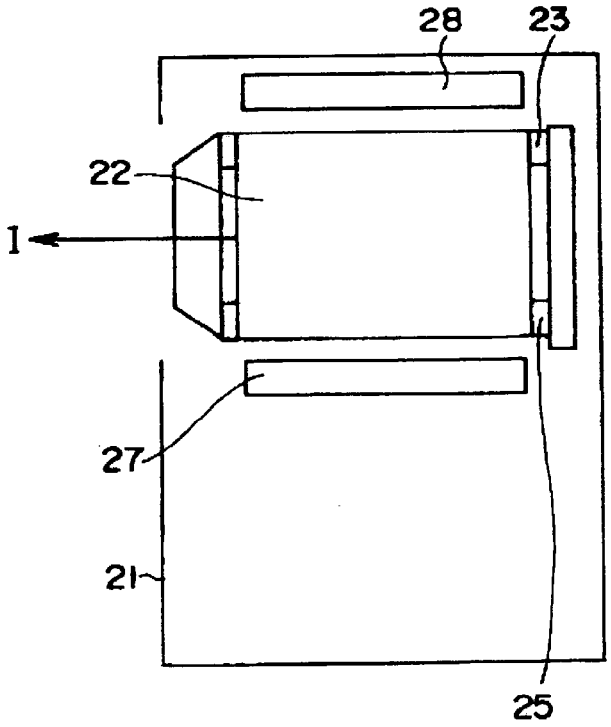
Figure 8A:
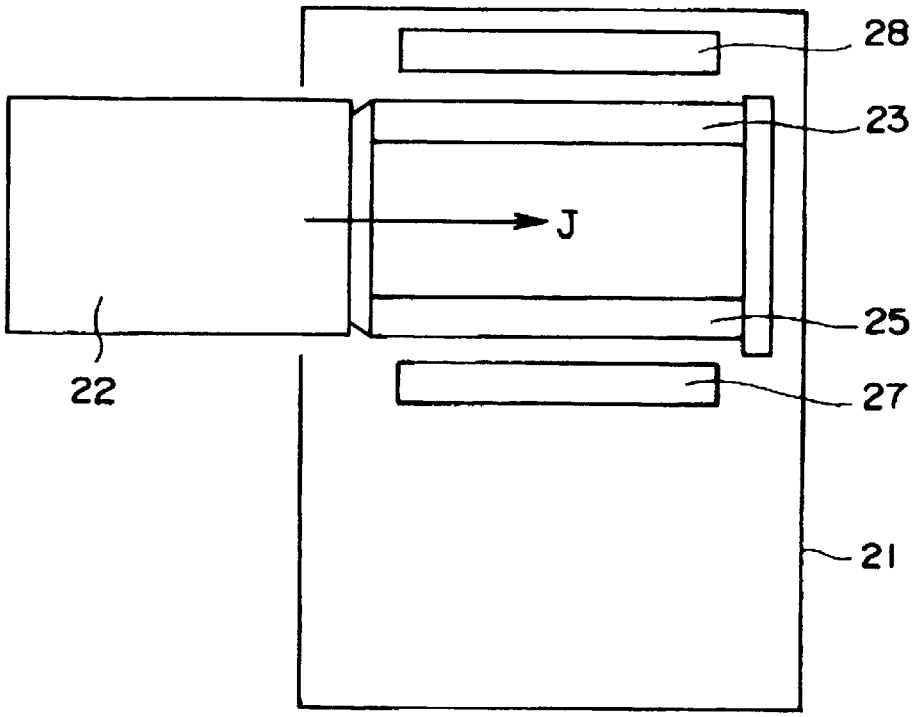
FIGS. 8A and 8B are schematic views for explaining a fitting method of the photosensitive belt provided in a conventional electrophotographic printer.
Figure 8B:
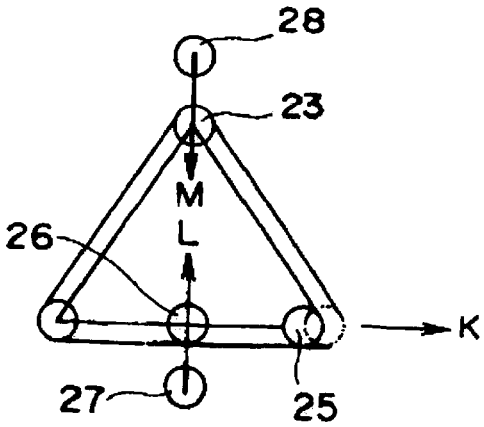

When a new photosensitive belt 2 is provided in the electrophotographic image forming device, the photosensitive belt 2 is returned by covering the belt driver 11, and moving in the direction indicated by the E-arrow in FIG. 5 while the driving roller 5 shifts toward the driving roller 4. After that, the driving roller 5 returns to the position where it was, and the photosensitive belt 2 becomes taut. Then, the upper housing 1*a* and the belt driver 11 swing and return to the position where they were. The photosensitive belt 2 is exchanged by these processes.

According to this embodiment, the special equipment for displacing the developing roller 7 and the transfer roller 8 are not needed only in order to exchange the photosensitive belt 2. Therefore, the electrophotographic image forming device of this embodiment has a simple structure and a low manufacturing cost, compared with a conventional electrophotographic image forming device.

In a conventional electrophotographic image forming device, when the photosensitive belt 22 is exchanged, the transfer roller 28 must shift with respect to the driving roller 23, and the developing roller 27 must shift with respect to the driving roller 26. Therefore, in order to return the transfer roller 28 and the developing roller 27 to the positions where they were, it is necessary to adjust respectively and carefully the positions of the transfer roller 28 and the driving roller 26. However, the transfer roller 8 is fixed to the upper housing 1*a,* and the developing roller 7 is fixed to the lower housing 1*b* in this embodiment. Therefore, the transfer roller 8 and the developing roller 7 are easily returned by closing the upper housing 1*a* and the belt driver 11.

According to the electrophotographic image forming device of this embodiment, the holding power for the photosensitive belt 2 at the intervals between the driving roller 3 and the transferring roller 8 and the driving roller 6 and the developing roller 7 are stabilized; therefore, the balance between these intervals can be easily adjusted. In addition, it is also possible adjust the holding power at these intervals.

Moreover, the electrophotographic image forming device in which the photosensitive belt 2 is provided is exemplified in this embodiment. However, the present invention includes an electrophotographic image forming device in which a photosensitive drum and a transfer belt are provided. In this case, the equipment for exchanging the transfer belt is simplified.

In addition, the first and second positioning sections may be provided with the hinge 10, the upper housing 1*a,* the lower housing 1*b,* etc.

What is claimed is:

1. An electrophotographic image forming device comprising:

a body comprising an upper housing and a lower housing, a photosensitive belt which is provided in the body, a belt driver for rotating the photosensitive belt, and a hinge joining the upper housing to the lower housing, and the belt driver to the lower housing so as to enable each of the upper housing and the belt driver to swing independently of each other during at least a portion of the range of motion of the belt driver and the upper housing relative to the lower housing.

2. An electrophotographic image forming device according to claim 1, wherein said belt driver comprises a plurality of driver rollers having rotation axes parallel to each other, and a tension/loosen member which loosens the tension of the photosensitive belt.

3. An electrophotographic image forming device comprising:

a body comprising an upper housing and a lower housing, a transfer belt which is provided in the body, a belt driver for rotating the transfer belt, and a hinge joining the upper housing to the lower housing, and the belt driver to the lower housing so as to enable each of the upper housing and the belt driver to swing independently of each other during at least a portion of the range of motion of the belt driver and the upper housing relative to the lower housing.

4. An electrophotographic image forming device according to claim 3, wherein said belt driver comprises a plurality of driver rollers having rotation axes parallel to each other, and a tension/loosen member which loosens the tension of the photosensitive belt.

5. A method of exchanging a photosensitive belt in an electrophotographic image forming device, the method comprising:

swinging each of an upper housing and a belt driver independently about a hinge during at least a portion of the range of motion of the belt driver and the upper housing with respect to a lower housing so that the belt driver is positioned between the upper housing and the lower housing, removing a photosensitive belt from the belt driver, and placing a new photosensitive belt onto the belt driver.

6. A method of exchanging a transfer belt in an electrophotographic image forming device, the method comprising:

swinging each of an upper housing and a belt driver independently about a hinge during at least a portion of the range of motion of the belt driver and the upper housing with respect to a lower housing so that the belt driver is positioned between the upper housing and the lower housing, removing a transfer belt from the belt driver, and placing a new transfer belt onto the belt driver.

7. An electrophotographic image forming device according to claim 2, further comprising a first positioning section which maintains a fixed swinging angle for the upper housing and a second positioning section which maintains a fixed swinging angle for the belt driver, wherein the swinging angle for the belt driver is smaller than the swinging angle for the upper housing.

8. An electrophotographic image forming device according to claim 2, wherein a developing roller is provided in the lower housing, and a transfer roller is provided in the upper housing.

9. An exchange method of a photosensitive belt according to claim 5, wherein said electrophotographic image forming device further comprises a tension/loosen member which loosens the tension of the photosensitive belt, said tension/loosen member comprising at least one shiftable driver roller, the method further comprising:

shifting said at least one driver roller so as to loosen the tension of the photosensitive belt before removing the photosensitive belt from the belt driver, and returning said at least one driver roller so as to tension the new photosensitive belt onto the belt driver.

10. An exchange method of a transfer belt according to claim 6, wherein said electrophotographic image forming device further comprises a tension/loosen member which loosens the tension of the transfer belt, said tension/loosen member comprising at least one shiftable driver roller, the method firther comprising:

shifting said at least one driver roller so as to loosen the tension of the transfer belt before removing the transfer belt from the belt driver, and returning said at least one driver roller so as to tension the new transfer belt onto the belt driver.

11. An electrophotographic image forming device according to claim 4, further comprising a first positioning section for maintaining a fixed swinging angle for the upper housing and a second positioning section for maintaining a fixed swinging angle for the belt driver, wherein the swinging angle for the belt driver is smaller than the swinging angle for the upper housing.

12. An electrophotographic image forming device according to claim 1, wherein said belt driver is covered by said photosensitive belt.

13. An electrophotographic image forming device according to claim 2, wherein said tension/loosen member comprises at least one shiftable drive roller.

14. An electrophotographic image forming device according to claim 3, wherein said belt driver is covered by said transfer belt.

15. An electrophotographic image forming device according to claim 4, wherein said tension/loosen member comprises at least one shiftable drive roller.

16. An electrophotographic image forming device according to claim 2, wherein the rotation axes of the plurality of driver rollers are perpendicular to an axis of the hinge.

17. An electrophotographic image forming device according to claim 4, wherein the rotation axes of the plurality of driver rollers are perpendicular to an axis of the hinge.

18. An exchange method of a photosensitive belt according to claim 5, wherein said belt driver comprises a plurality of drive rollers having rotation axes arranged perpendicular to an axis of the hinge, wherein said plurality of drive rollers swing around the axis of said hinge when said belt driver swings about said hinge.

19. An exchange method of a transfer belt according to claim 6, wherein said belt driver comprises a plurality of drive rollers having rotation axes arranged perpendicular to an axis of the hinge, wherein said plurality of drive rollers swing around the axis of said hinge when said belt driver swings about said hinge.

* * * * *